US005211687A

United States Patent [19]

Loser

[11] Patent Number: 5,211,687

[45] Date of Patent: May 18, 1993

[54] APPARATUS AND METHOD FOR PRODUCING A HOLE IN AN ARTICLE OF WOOD OR WOOD PRODUCT

[75] Inventor: Larry L. Loser, Holland, Mich.

[73] Assignee: Herman Miller, Inc., Zeeland, Mich.

[21] Appl. No.: 811,454

[22] Filed: Dec. 4, 1991

[51] Int. Cl.[5] ..... B27M 1/02; B26F 1/24

[52] U.S. Cl. ..... 144/361; 83/30; 83/660; 83/868; 144/2 R

[58] Field of Search ..... 83/30, 669, 684, 687, 83/691, 868, 866, 660; 144/2 R, 361

[56] References Cited

U.S. PATENT DOCUMENTS

| | | | |
|---|---|---|---|
| 343,180 | 6/1886 | Leavitt et al. | 83/660 |
| 2,355,454 | 8/1944 | Lucius | 83/30 |
| 3,143,026 | 8/1964 | Akerson | 83/686 |
| 3,167,151 | 1/1965 | Jack et al. | 181/33 |
| 3,248,977 | 5/1966 | Schneider | 83/868 |
| 3,463,042 | 8/1969 | Goldman | 83/627 |
| 3,477,322 | 11/1969 | Gerber et al. | 83/660 |
| 3,973,453 | 8/1976 | Tameo | 83/30 |
| 3,996,832 | 12/1976 | Schubert et al. | 83/686 |
| 4,104,942 | 8/1978 | Leloux | 83/660 |
| 4,674,372 | 6/1987 | Mobley | 83/30 |

*Primary Examiner*—W. Donald Bray

*Attorney, Agent, or Firm*—Willian, Brinks, Olds, Hofer, Gilson & Lione

[57] ABSTRACT

An apparatus and method for producing a hole in an article comprising wood or wood products includes a piercing tool having a punch extending therefrom. One of said piercing tool and article is moved relative to the other such that the piercing tool is positioned in a desired location relative to the article. The punch is propelled outwardly with a sufficient impact load to create a hole in the article and then retracted.

40 Claims, 5 Drawing Sheets

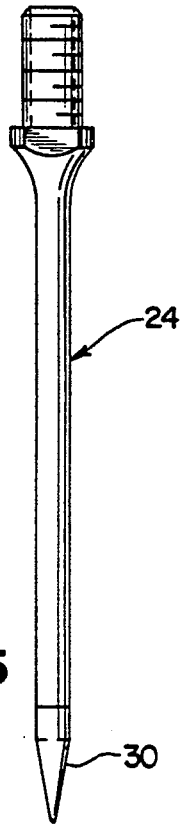
Fig. 5
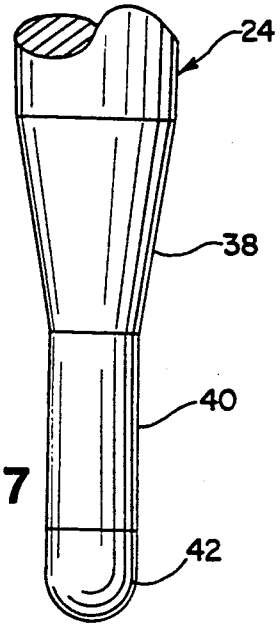
Fig. 7
Fig. 8
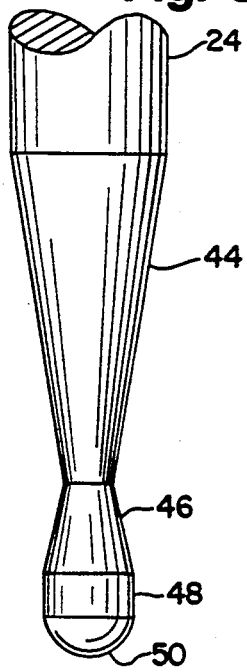
Fig. 6
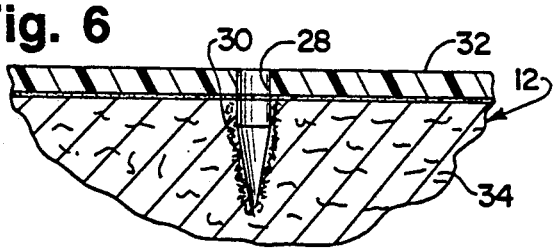
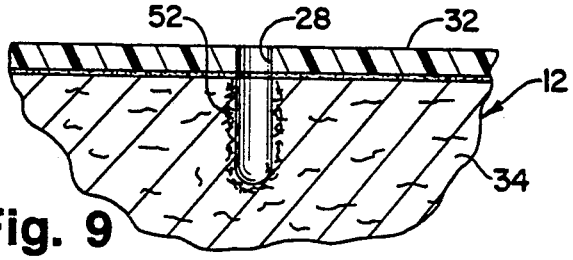
Fig. 9

Fig. 11
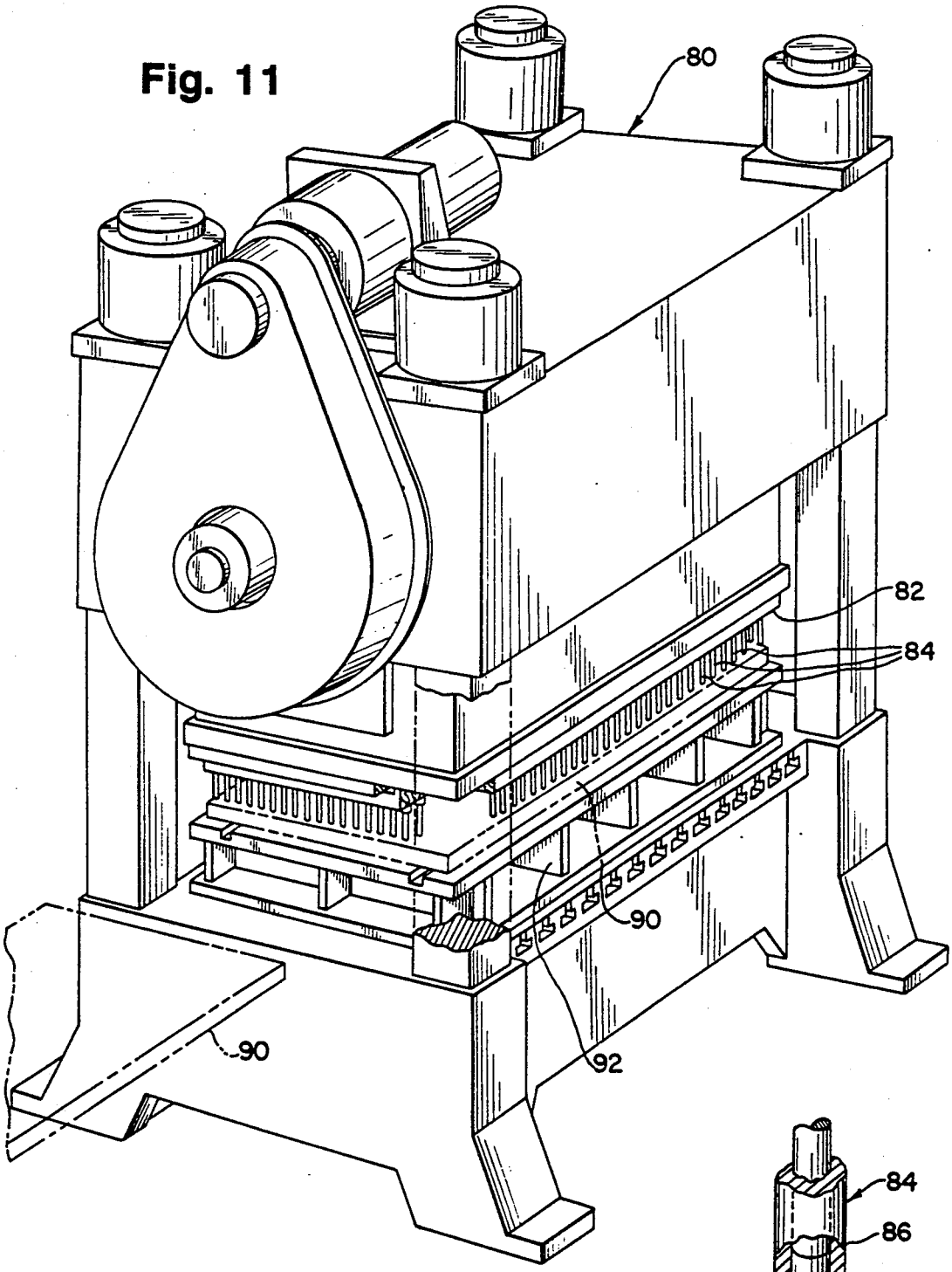
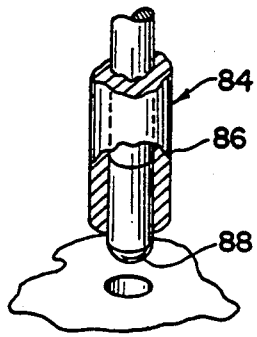
Fig. 12

APPARATUS AND METHOD FOR PRODUCING A HOLE IN AN ARTICLE OF WOOD OR WOOD PRODUCT

BACKGROUND OF THE INVENTION

The present invention relates generally to producing a hole in an article, and in particular, to an apparatus and method for producing a plurality of screw holes in an article of wood or wood product using a high pressure device and a punch.

Typically, conventional drilling machines are used to form screw holes in wood panels. These machines tend to be bulky, slow and costly, and the drilling operation tends to produce a substantial amount of dust and debris which increases clean-up costs. When these machines are used to produce holes in laminated particleboard, the resulting holes tend be defined by a non-uniform, non-compact wall. As a result, the holes must be drilled relatively deep to provide sufficient holding power for the fastening of screws to the low-density particleboard. In addition, it is difficult to drill holes in the edges of a wood panel with conventional drilling machines.

A number of prior art devices use a stationary pneumatic cylinder in cooperation with a ball and die to punch a plurality of holes through a web of material which continuously moves between the cylinder and die. Devices of this type are disclosed in U.S. Pat. Nos. 4,674,372 (Mobley) and 3,463,042 (Goldman). In U.S. Pat. No. 3,996,832 (Schubert et al.), a plurality of stationary pneumatic cylinders are used in cooperation with a plurality of dies and flat punches having a curved cutting edge for punching a slot through a plastic container.

In U.S. Pat. No. 3,167,151 (Jack et al.), a method of forming a plurality of perforations in an acoustic panel is disclosed which includes the step of pressing a stepped punch having a flat end into a surface of the panel.

In U.S. Pat. No. 3,143,026 (Akerson), a tool having a shank and a tapered end portion with a flat end is disclosed for punching holes in acoustic panels.

SUMMARY OF THE INVENTION

Briefly stated, the invention is directed to an apparatus and method for producing a hole in an article comprising wood or wood products. A piercing tool has a punch extending therefrom and means for propelling the punch outwardly with a sufficient impact load to create a hole in the article. One of said piercing tool and article is moved relative to the other such that the piercing tool is positioned in a desired location relative to the article. The propelling means is actuated to propel the punch through a surface of the article and thereby produce a hole therein, and the punch is retracted.

In a preferred embodiment of the invention, a robotics machine is used to move the piercing tool relative to the article and produce a plurality of holes therein. The piercing tool is attached to an arm of the robotics machine, the article is secured in a predetermined reference position, and desired coordinates are enter in the robotics machine. To create a desired pattern of holes, the robotics machine is actuated to automatically move the piercing tool to a plurality of desired locations. The means for propelling the punch outwardly preferably comprises a pneumatic cylinder.

In another embodiment of the invention, the panel is placed on passively rotatable, horizontal rollers rotatably connected to a support structure. The panel is moved in a horizontal, longitudinal direction by an actively driven roller. A plurality of the piercing tools are horizontally aligned above the panel and moved in a lateral direction to a plurality of desired locations relative to the panel. To create a desired pattern of holes, the punches are propelled out of a desired number of cylinders at desired time intervals.

To produce holes in laminated particleboard, the punch preferably has a cylindrical end portion with a spherical terminal end to prevent cracking of the laminate and produce a hole defined by a substantially cylindrical, uniform, compact wall. In another embodiment, the punch has a conical end portion to prevent cracking of the laminate, produce a hole defined by substantially uniform, compact wall, and allow the punch to be easily withdrawn. The preferred angle of the conical end portion relative to the axis of the punch is approximately 10°. In yet another embodiment, the punch includes a first frusto-conical portion converging toward the axis of the punch, a second frusto-conical portion extending therefrom and diverging away from the axis of the punch, and a cylindrical end portion extending from the second frusto-conical portion and having a substantially terminal end.

The present invention provides significant advantages over other methods and devices for producing holes in articles of wood or wood products such as laminated particleboard. Compressing the particleboard to produce a hole rather than drilling the hole produces no dust, which decreases clean-up costs. The holding power of the particleboard may also be greater because the hole is defined by a substantially uniform, compact wall, thus allowing the use of a shorter screw in a shorter hole. In addition, using a robotics machine which rapidly moves a piercing tool to a plurality of desired locations greatly increases the speed with which the holes can be produced and decreases costs. The high-speed, high-impact piercing tool of the present invention is especially compataible wiht the high-speed robotics machine to produce a desired number of holes in a minimal period of time. For example, the robotics machine and piercing tool of the present invention produces 71 holes in a 30×72 Action Office® or Encore® wall panel, manufactured by Herman Miller, Inc., in approximately 50 seconds, whereas a conventional drilling machine produces the same number of holes in approximately 2½ minutes. The present invention is also more versatile than a traditional drilling machine since the greater range and types of motion provided by the robotics machine allows an article to be positioned in any manner. In addition, the versatility of the robotics machine tends to make it easier to produce holes in the edges of a panel.

The present invention, together with further objects and advantages, will be best understood by reference to the following detailed description taken in conjunction with the accompanying drawings.

BRIEF DESCRIPTION OF THE DRAWINGS

FIG. 5 is a front view of a preferred embodiment of the punch.

FIG. 6 is a fragmentary cross-sectional view of a laminated particleboard showing a hole created by the punch shown in FIG. 5.

FIG. 7 is a front view of another embodiment of the punch.

FIG. 8 is a front view of yet another embodiment of the punch.

FIG. 9 is a fragmentary cross-sectional view of a panel comprising laminated particleboard showing a hole created by the punch shown in FIGS. 7 and 8.

FIG. 11 is perspective view of another embodiment of the invention utilizing a high speed press.

FIG. 12 is a fragmentary cross-sectional view of a punch assembly including a punch and a sleeve.

DETAILED DESCRIPTION OF THE PREFERRED EMBODIMENTS

Figure 1:
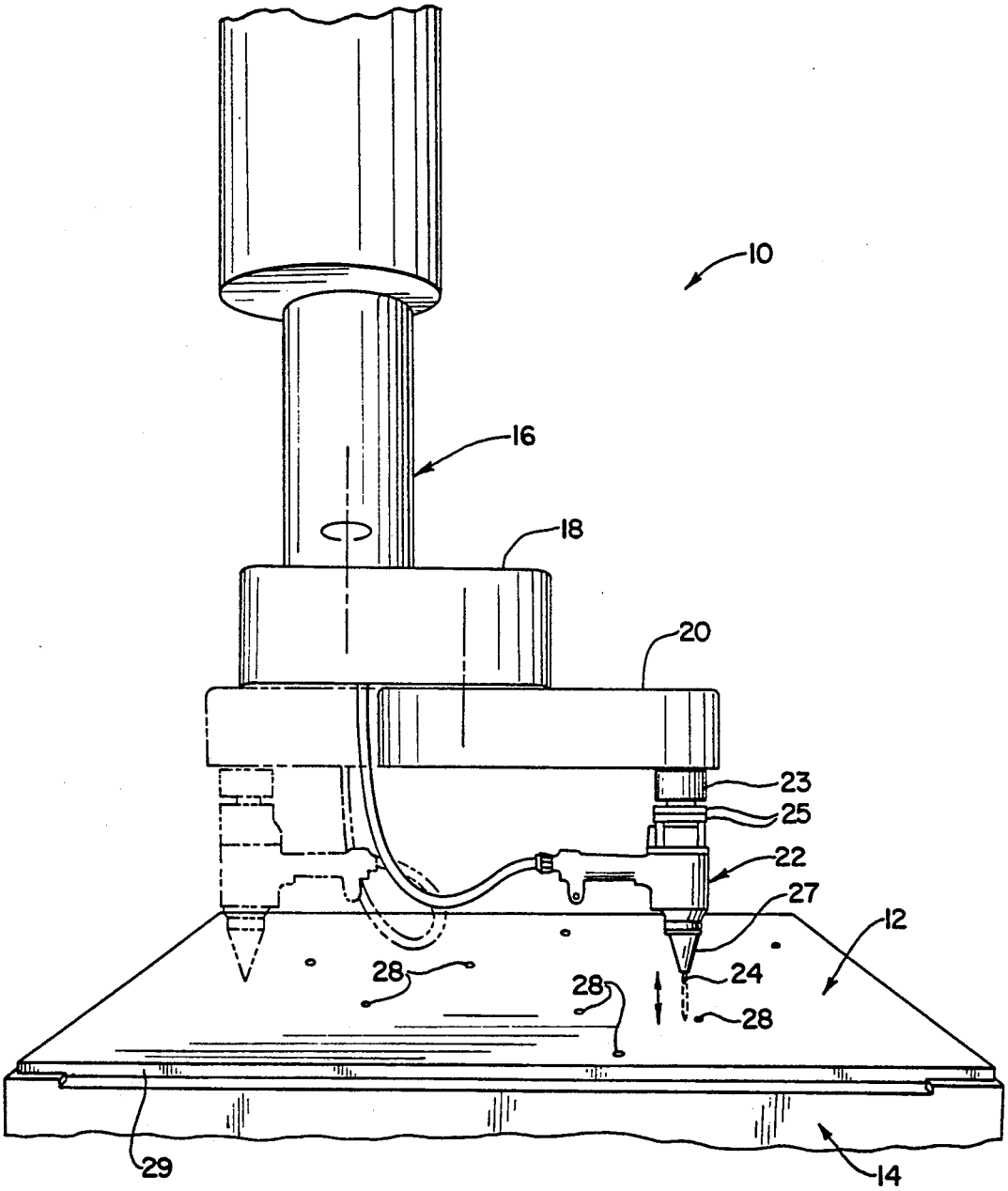
FIG. 1 is a perspective view of a preferred embodiment of the invention showing a piercing tool attached to an arm of an industrial robotics machine with a punch extending outward therefrom.
Figure 3:
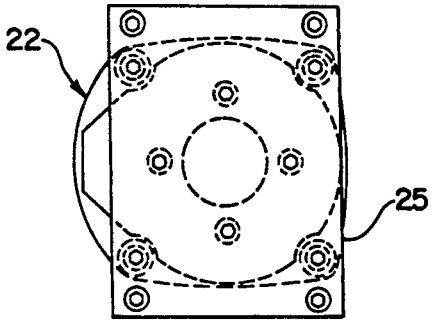
FIG. 3 is a top view of the piercing tool shown in FIG. 2.
Figure 2:
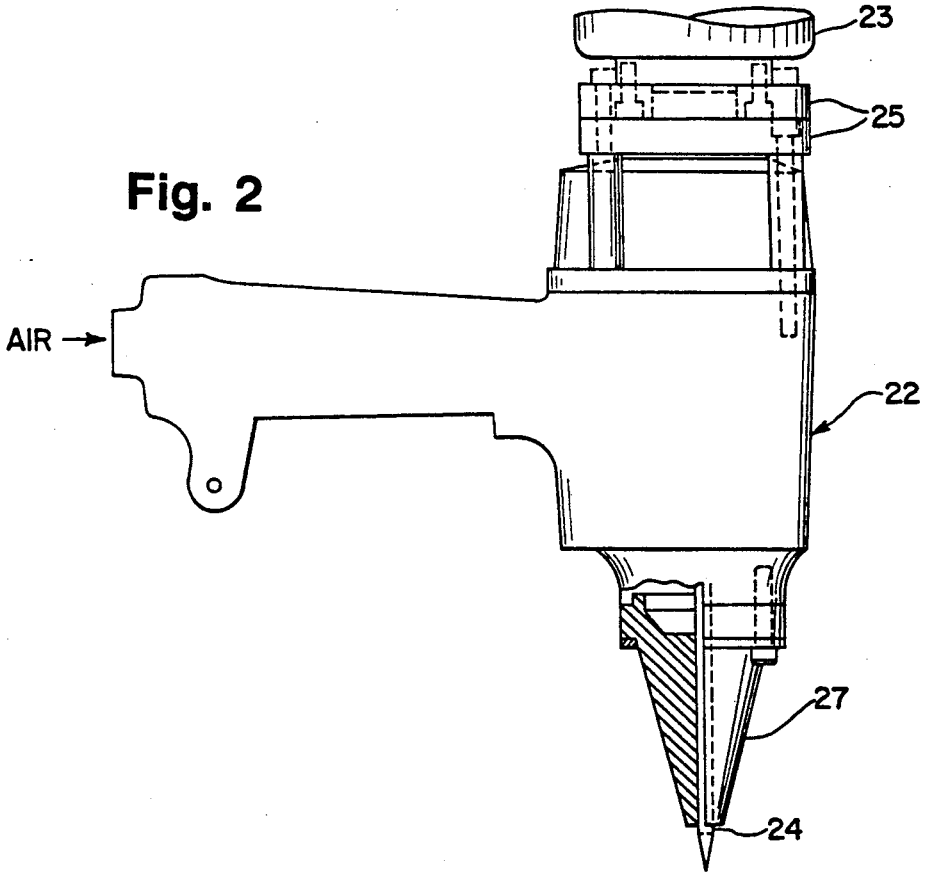
FIG. 2 is a front view of the piercing tool shown in FIG. 1.

Referring to the drawings, FIG. 1 shows a preferred embodiment of a hole punching apparatus indicated generally at 10. A panel 12 comprising laminated particleboard is secured to a support structure 14 in a predetermined reference position. The panel 12 can be any shape or size and can comprise various types of wood or wood product such as plywood or the like. A conventional industrial robotics machine 16, preferably GMF model A-510E, includes a first rotatable arm 18 and a second rotatable arm 20 positioned above the panel 12. The arms 18 and 20 are adapted to automatically move to a plurality of desired locations relative to the panel 12 in response to coordinates entered in a control panel (not shown) of the robotics machine 16.

A conventional piercing tool 22, preferably BEA model T612, is attached to an end 23 of the second arm 20 of the robotics machine 16 by a pair of plates 25. The piercing tool 22 has a pneumatic cylinder (not shown) for supplying high pressure to a punch 24, and a cone-shaped adapter 27 for guiding the punch 24 outwardly therefrom. When the piercing tool 22 is moved to a desired location relative to the panel 12, the punch 24 is propelled outwardly from the pneumatic cylinder with a sufficient impact load to punch a hole 28 in the panel 12, and the punch 24 is retracted into the cylinder to allow movement of the piercing tool 22 to a new location. Preferably, the position of the piercing tool 22 relative to the panel 12 and the stroke of the punch 24 are such that the holes 28 have a depth of approximately 250/1,000 of an inch.

In operation, the panel 12 is secured to the support structure 14 in a predetermined reference position, the desired hole coordinates are entered in the robotics machine control panel, and the robotics machine 16 is actuated by control means (not shown). Tha arms 18 and 20 move to a plurality of desired locations in which the piercing tool 22 and punch 24 overlie a desired hole location, and the punch 24 is propelled out of the cylinder to punch the hole 28 in the panel 12. The punch 24 is then retracted into the cylinder at each of said locations to allow the piercing tool 22 to move to a new location.

Any suitable robotics system can be used for moving the piercing tool 22 to a plurality of desired locations, such as Motoman model K10-S or ABB model IRB-2000, and any suitable nail-gun type piercing tool can be used to force the punch 24 into the panel 12, such as Bostich model N-55 or Hitachi model NV50A1. The piercing tool is preferably equipped with a pneumatic cylinder, although any suitable means for propelling the punch 24 outwardly with a sufficient impact load to produce a hole in the panel 12 can be provided. The panel 12 can be positioned horizontally as well as vertically, and the holes 28 can be punched in edges 29 of the panel 12. The robotics machine 16 can also be adapted to produce holes in a plurality of continuously moving panels 12. Although slower and more expensive, conventional drilling machines can also be retrofitted with the piercing tool 22 to punch the holes in the panel 12.

In one embodiment, the punch 24 has a conical end portion 30 which pierces a laminate 32 such as formica or plastic and produces a hole 28 in the laminate 32 and relatively low-density particleboard 34 of the panel 12 (FIGS. 5 and 6). Preferably, the angle of the conical end portion 30 relative to the axis of the punch is approximately 10° to prevent cracking of the laminate 32 and allow the punch 24 to be easily withdrawn from the particleboard 34. In addition, the hole 28 is defined by a substantially uniform, compact wall 36 which may provide more holding power than the low-density particleboard 34.

Figure 4:
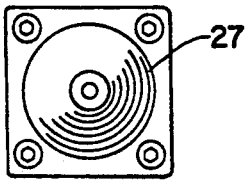
FIG. 4 is a bottom view of the piercing tool shown in FIGS. 2 and 3.

FIG. 7 shows another embodiment of the punch 24 in which the punch has a frusto-conical portion 38, a cylindrical portion 40, and a substantially spherical terminal end 42. FIG. 8 shows yet another embodiment of the punch 24 in which the punch has a first frusto-conical portion 44 converging toward the axis of the punch 24, a second frusto-conical portion 46 extending therefrom and diverging away from the axis of the punch 24, and a cylindrical end portion 48 extending from the second frusto-conical portion 46 and having a substantially spherical terminal end 50. As shown in FIG. 9, the embodiments of the punch 24 in FIGS. 4 and 5 both create a hole 28 defined by a compact wall 52 having a uniform diameter. These embodiments also prevent cracking of the laminate 32 and allow the punch 24 to be easily withdrawn from the particleboard 34. In addition, the cylindrical portions 40 and 48 of the punches 24 in FIGS. 7 and 8 preclude resin buildup on the wall 52 because they tend to wipe any resin therefrom as the punch 24 is retracted from the panel 12.

The punch 24 can be any shape which prevents cracking of the laminate 32 and allows the punch 24 to be easily withdrawn from the particleboard 34 or other article comprising wood or wood products. The punches 24 are preferably made of steel, and the conical end portion 30 of the punch in FIG. 5 and the spherical ends 42 and 50 of the punches 24 in FIGS. 7 and 8 are preferably carbide tips polished to a mirror finish. In addition, titanium nitride coatings can be applied to the end portions of the punch 24 for increased lubricity and enhanced wear resistance.

Figure 10:
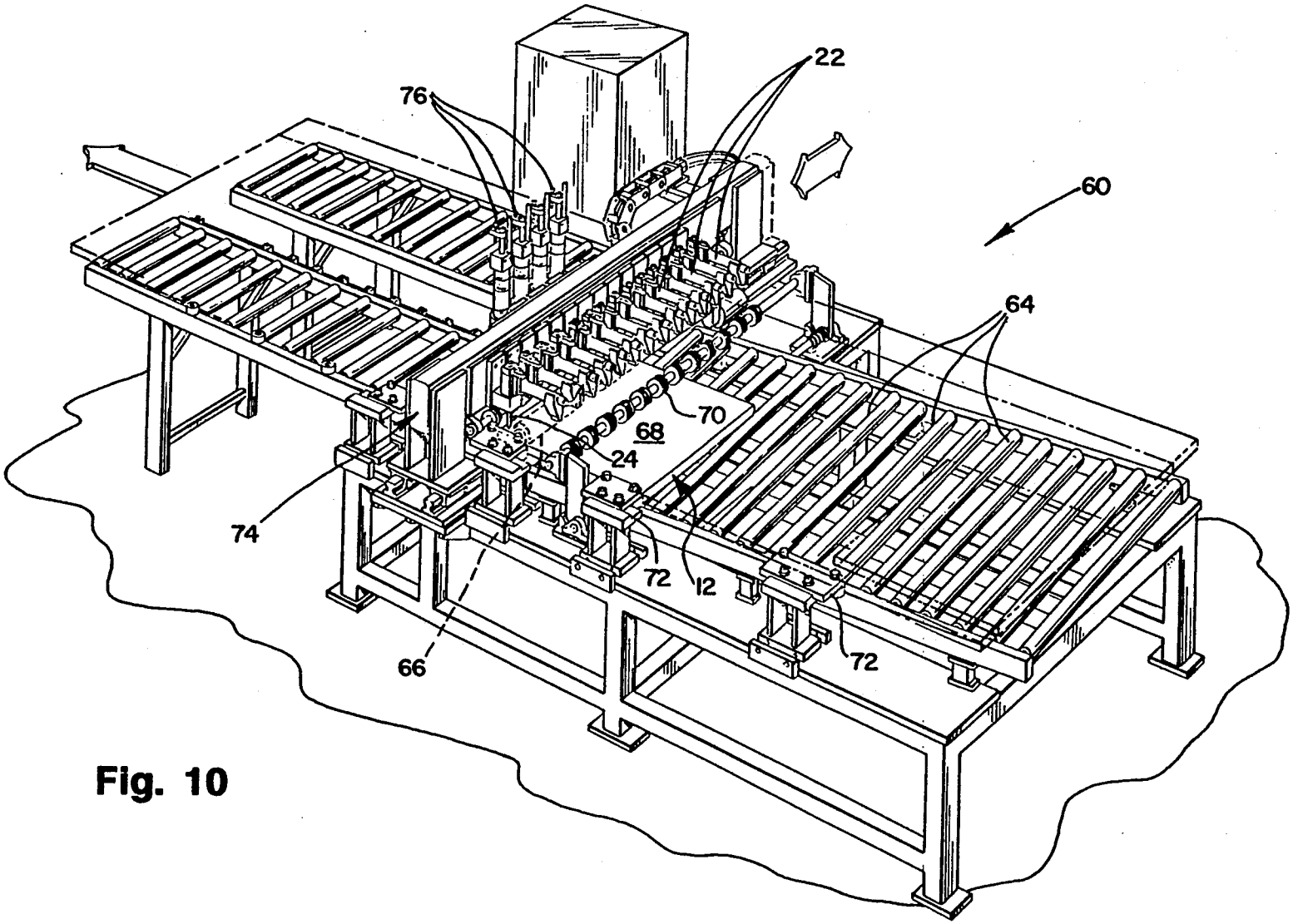
FIG. 10 is a perspective view of an alternative embodiment of the invention showing a plurality of piercing tools and a panel positioned below the tools and upon a plurality of rollers which are rotatably attached to a support structure.

In FIG. 10, an alternative embodiment of the invention is indicated generally at 60. A support structure 62 includes a plurality of passively rotatable, horizontal rollers 64 rotatably connected thereto for the placement of the panel 12 horizontally thereon. An actively driven roller 66 contacts a top surface 68 of the panel 12 to incrementally move the panel in a horizontal, longitudinal direction. In addition, a hold-down roller 70 contacts the top surface 68 of the panel 12 and side locators 72 are provided for guiding the panel 12 longitudinally. A plurality of the piercing tools 22 are mounted to a horizontal brace 74 which is positioned laterally above the panel 12 and moveable in a lateral direction.

In operation, the panel 12 is placed on the rollers 64 and moved incrementally in a longitudinal direction by the drive roller 66. The brace 74 is moved laterally to a plurality of desired locations in which the piercing tools 22 are positioned above the panel 12 at desired hole locations, and the punches 24 are propelled downwardly from a desired number of cylinders at desired time intervals with sufficient force to punch holes in the panel 12. The punches 24 are then retracted into the cylinders to allow the panel 12 and piercing tools 22 to move to a new location, thus creating a desired pattern of holes in the panel 12. In addition, a plurality of conventional drills 76 can be provided to produce larger diameter holes.

Any means for supporting the panel 12 can be provided which allows horizontal movement of the panel 12, and any drive means can be provided for moving the panel 12 in a longitudinal direction. In addition, any number of piercing tools 22 can be positioned in a desired arrangement above the panel 12 and can be adapted to move in desired directions to create a desired pattern of holes in the panel 12. The piercing tools 22 can also be stationary if the desired holes are evenly spaced across the width of the panel 12. Furthermore, the drive rollers 66 can be adapted to move a plurality of panels 12 horizontally at a constant velocity, and control means can be provided for actuating the piercing tools 22 at desired time intervals to create a desired pattern of holes in the panel 12.

FIGS. 11 and 12 illustrate yet another alternative embodiment of the invention. A conventional, high speed mechanical or hydraulic press 80 is adapted to hold a tooling plate 82 having a plurality of punch assemblies 84 extending downwardly therefrom. The punch assemblies 84 preferably include a resilient sleeve 86 surrounding a punch 88. The plate 82 can be adapted with a fixed placement punch holder (not shown) for producing a fixed hole pattern, or an adjustable position punch holder (not shown) for producing an easily changeable hole pattern.

In operation, a panel 90 is placed in a desired position on a support structure 92 underneath the punch assemblies 84. The press 80 is actuated to move the tooling plate 82 downwardly with a sufficient impact load for the punches 88 to produce a hole in the panel 90, and the sleeves 86 are compressed between the plate 82 and panel 12. The tooling plate 82 and punches 88 are retracted from the panel 12, and the sleeves 86 expand to prevent debris from collecting on the punches 88.

Thus, an apparatus and method for punching holes in an article comprising wood or wood product is provided which produces no dust, creates holes which may have greater holding power than drilled holes, greatly increases the speed with which the holes can be produced, and decreases costs. The robotics aspect of the present invention is also more versatile than a traditional drilling machine because a robotics machine has a greater range of motion and is capable of various types of motion, thus providing the capability of producing holes in a vertical panel, the edges of a panel, or an inclined or other non-horizontal surface of an article. Furthermore, the reduction of shear stress resulting from the rotation of a drill bit may make it easier to produce holes in the edges of a panel.

Although the present invention has been described with reference to preferred embodiments, workers skilled in the art will recognize that many changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

I claim:

1. A method for producing a screw hole in an article comprising wood or wood products, the method comprising:

providing a piercing tool having a punch extending therefrom and means for propelling said punch outwardly with a sufficient impact load to create a screw hole in the article;

automatically moving one of said piercing tool and article relative to the other such that the piercing tool is positioned in a desired location relative to the article;

actuating said propelling means to propel the punch through a surface of the article and thereby produce a screw hole therein; and retracting the punch.

2. The method of claim 1, wherein said steps are repeated a desired number of times to produce a plurality of screw holes in the article.

3. The method of claim 1, wherein the piercing tool is attached to a robotics machine which automatically moves the piercing tool to a plurality of desired locations, actuates the piercing tool at each of said locations to propel the punch through a surface of the article and produce a screw hole therein, and retracts the punch at each location.

4. The method of claim 1, wherein the step of moving one of said piercing tool and article relative to the other comprises placing the article on support means adapted to allow horizontal movement thereof and moving the article in a horizontal direction by drive means.

5. The method of claim 1, wherein both the piercing tool and article move relative to each other.

6. The method of claim 1, wherein the means for propelling the punch outwardly comprises a pneumatic cylinder.

7. A method for producing a plurality of screw holes in an article comprising wood or wood products, the method comprising:

providing a piercing tool including a punch extending therefrom and a pneumatic cylinder for propelling said punch outwardly with a sufficient impact load to create a hole in the article;

automatically moving one of said piercing tool and article relative to the other such that the piercing tool is positioned in a plurality of desired locations relative to the article;

actuating said pneumatic cylinder to propel the punch through a surface of the article and produce a hole therein at each of said locations; and retracting the punch at each of said locations;

whereby a plurality of holes are formed in the panel in a desired pattern.

8. The method of claim 7, wherein both the piercing tool and article more relative to each other.

9. The method of claim 7, wherein the piercing tool is attached to a robotics machine which automatically moves the piercing tool to a plurality of desired locations, actuates the piercing tool at each of said locations to propel the punch through a surface of the article and produce a screw hole therein, and retracts the piercing tool at each location.

10. The method of claim 7, wherein the step of moving one of said piercing tool and article relative to the other comprises placing the article on support means adapted to allow horizontal movement thereof and moving the article in a horizontal direction by drive means.

11. A method for producing a plurality of screw holes in an article comprising wood or wood products, the method comprising:

placing the article in a predetermined reference position;

entering desired coordinates in a robotics machine having an arm with a piercing tool attached thereto, said piercing tool having a punch extending therefrom and a pneumatic cylinder for propelling said punch outwardly therefrom with a sufficient impact load to create a hole in the article; and actuating the robotics machine, wherein the piercing tool of said robotics machine automatically moves to a plurality of desired locations, and the punch is propelled outwardly from the cylinder and retracted into said cylinder at each of said locations to produce a hole in the article at each location.

12. The method of claim 11, further comprising the step of moving a plurality of articles in a horizontal direction at a constant velocity.

13. A method for producing a plurality of screw holes in an article comprising wood or wood products, the method comprising:

placing the article on support means adapted to allow horizontal movement of said article;

moving the article in a horizontal direction by drive means;

propelling a punch downwardly from a desired number of pneumatic cylinders housed in a plurality of piercing tools, said piercing tools being positioned above the article and said punches being propelled out of the cylinders with a sufficient impact load to punch a hole in the article; and retracting the punches into said cylinders;

whereby a desired pattern of holes are formed in the article.

14. The method of claim 13, wherein the drive means moves a plurality of articles in a horizontal direction at a constant velocity and the punches are propelled out of the piercing tools at desired time intervals while the articles are moving.

15. The method of claim 13, further comprising the step of moving the piercing tools to a desired location relative to the article.

16. A method for producing a plurality of screw holes in an article comprising wood or wood products, the method comprising:

placing the article on passively rotatable, horizontal rollers rotatably connected to a support structure;

moving the article in a horizontal, longitudinal direction by an actively driven roller;

moving a plurality of horizontally aligned piercing tools positioned above the article in a lateral direction to a plurality of desired locations relative to the article, said piercing tools including a pneumatic cylinder having a punch extending downwardly therefrom;

propelling the punches downwardly from a desired number of cylinders at desired time intervals with a sufficient impact load to produce a hole in the article; and retracting the punches into said cylinders to allow the article and piercing tools to move to a new location;

whereby a desired pattern of holes area formed in the article.

17. The method of claim 16, wherein the drive the drive roller moves a plurality of articles in a horizontal direction at a constant velocity and the punches are propelled out of the piercing tools while the articles are moving.

18. An apparatus for producing a screw hole in an article comprising wood or wood products, the apparatus comprising:

means for supporting the article;

a piercing tool including a punch and actuating means for propelling the punch outwardly from the piercing tool and retracting the punch into said tool, said actuating means being adapted to propel the punch outwardly with a sufficient impact load to create a screw hole in the article;

means for supporting the piercing tool adjacent a surface of the article such that the axis of the punch is perpendicular to the surface of the article; and means for automatically moving one of said article and piercing tool relative to the other such that the piercing tool is positioned in a desired location relative to the article.

19. The apparatus of claim 18, wherein the piercing tool is attached to a robotics machine which automatically moves the piercing tool to a plurality of desired locations, actuates the piercing tool at each of said locations to propel the punch through a surface of the article and produce a screw hole therein, and retracts the piercing tool at each location.

20. The apparatus of claim 18, wherein the means for moving one of said piercing tool and article relative to the other comprises drive means adapted to cooperate with the support means to move the article in a horizontal direction.

21. The apparatus of claim 18, further comprising means for moving both the piercing tool and article relative to the other.

22. The apparatus of claim 18, wherein the means for propelling the punch outwardly comprises a pneumatic cylinder.

23. An apparatus for producing a plurality of screw holes in a panel comprising laminated particleboard, the apparatus comprising:

means for supporting the panel;

a piercing tool including a punch and actuating means for propelling the punch outwardly from the piercing tool and retracting the punch into said tool, said actuating means being adapted to propel the punch outwardly with a sufficient impact load to create a hole in the laminate and particleboard;

means for supporting the piercing tool adjacent a surface of the laminate such that the axis of the punch is perpendicular to the panel; and means for moving one of said panel and piercing tool relative to the other such that the piercing tool is positioned in a plurality of desired locations relative to the panel;

whereby a plurality of holes are produced in the panel in a desired pattern.

24. The apparatus of claim 23, wherein the punch has a conical end portion to prevent cracking of the laminate and create a hole defined by a substantially uniform, compact wall.

25. The apparatus of claim 23, wherein the punch has a substantially cylindrical end portion and a substantially spherical terminal end to create a hole with a uniform diameter.

26. The apparatus of claim 23, wherein the punch includes a first frusto-conical portion converging toward the axis of the punch, a second frusto-conical portion extending therefrom and diverging away from the axis of the punch, and a cylindrical end portion extending from the second frusto-conical portion, the cylindrical end portion having a substantially spherical terminal end.

27. The apparatus of claim 23, wherein the piercing tool is attached to a robotics machine which automatically moves the piercing tool to a plurality of desired locations, actuates the piercing tool at each of said locations to propel the punch through a surface of the article and produce a hole therein, and retracts the piercing tool at each location.

28. The apparatus of claim 23, wherein the means for moving one of said piercing tool and article relative to the other comprises drive means adapted to cooperate with the support means to move the article in a horizontal direction.

29. The apparatus of claim 23, further comprising means for moving both the piercing tool and article relative to the other.

30. The apparatus of claim 23, wherein the means for propelling the punch outwardly comprises a pneumatic cylinder.

31. An apparatus for producing a plurality of screw holes in a panel comprising laminated particleboard, the apparatus comprising:

means for supporting the panel in a predetermined reference position;

a robotics machine having an arm adapted to automatically move to a desired location relative to the panel;

a piercing tool adapted to be connected to an end of said arm, said piercing tool including a pneumatic cylinder and a punch extending outwardly therefrom, said pneumatic cylinder being adapted to propel the punch outwardly with a sufficient impact load to produce a hole in the laminate and particleboard when the cylinder is in a desired location relative to said panel, and an end portion of the punch having a shape sufficient to prevent the laminate from cracking, produce a hole having a substantially uniform, compact wall, and preclude the punch from locking in the particleboard; and control means for actuating said robotics machine;

whereby the robotics machine is actuated by the control means, the arm moves to a plurality of desired locations, and the punch is propelled out of the cylinder to produce a hole in the panel and retracted into the cylinder at each of said locations.

32. The apparatus of claim 31, wherein the end portion of the punch is conical.

33. The apparatus of claim 31, wherein the end portion of the punch is substantially cylindrical and has a substantially spherical terminal end to create a hole with a uniform diameter.

34. The apparatus of claim 33, wherein the cylindrical end portion extends from a frusto-conical portion of the punch.

35. The apparatus of claim 31, wherein the punch includes a first frusto-conical portion converging toward the axis of the punch, a second frusto-conical portion extending therefrom and diverging away from the axis of the punch, and a cylindrical end portion extending from the second frusto-conical portion, the cylindrical end portion having a substantially spherical terminal end.

36. An apparatus for producing a plurality of screw holes in a panel comprising laminated particleboard, the apparatus comprising:

means for supporting the panel, said means being adapted to allow horizontal movement of said panel;

drive means for moving the panel in a horizontal direction;

a plurality of piercing tools positioned above the panel, said piercing tools including a pneumatic cylinder and a punch extending outwardly therefrom, said cylinders being adapted to propel the punch outwardly with a sufficient impact load to pierce the laminate and produce a hole in the laminate and particleboard when the panel is in a desired location relative to the cylinders, an end portion of the punch having a shape sufficient to prevent the laminate from cracking, produce a hole having a substantially uniform, compact wall, and preclude the punch from locking in the particleboard; and control means for actuating the punches out of a desired number of cylinders at desired time intervals to produce a desired pattern of holes in the panel.

37. The apparatus of claim 36, wherein the end portions of the punches are conical.

38. The apparatus of claim 36, wherein the end portions of the punches are substantially cylindrical and have a substantially spherical terminal end to create a hole with a uniform diameter.

39. The apparatus of claim 38, wherein the punches include a first frusto-conical portion converging toward the axis of the punch, a second frusto-conical portion extending therefrom and diverging away from the axis of the punch, and a cylindrical end portion extending from the second frusto-conical portion, the cylindrical end portion having a substantially spherical terminal end.

40. An apparatus for producing a hole in an article comprising wood or wood products, the apparatus comprising:

a high-speed press having a punch extending downward therefrom, said press being adapted to force the punch into the article with a sufficient impact load to create a hole in said article.

* * * * *

UNITED STATES PATENT AND TRADEMARK OFFICE

CERTIFICATE OF CORRECTION

PATENT NO. : 5,211,687

DATED : May 18, 1993

INVENTOR(S) : LARRY L. LOSER

It is certified that error appears in the above-identified patent and that said Letters Patent is hereby corrected as shown below:

Column 1, line 61, delete "enter" and substitute --entered--.

Column 2, line 41, delete "compataible wiht" and substitute --compatible with--.

Column 3, line 63, delete "Tha" and substitute --The--.

Col. 6; Claim 8, line 2, delete "more" and substitute --move--.

Col. 8; Claim 16, line 21, delete "area" and substitute --are--.

Signed and Sealed this

Second Day of August, 1994

*Attest:*

*Attesting Officer*

BRUCE LEHMAN

*Commissioner of Patents and Trademarks*